US010506910B2

(12) United States Patent
Lee et al.

(10) Patent No.: US 10,506,910 B2
(45) Date of Patent: Dec. 17, 2019

(54) DISHWASHER AND METHOD OF MANUFACTURING THE SAME

(71) Applicant: LG ELECTRONICS INC., Seoul (KR)

(72) Inventors: Sangsoo Lee, Seoul (KR); Donghwi Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 35 days.

(21) Appl. No.: 15/303,685

(22) PCT Filed: May 18, 2016

(86) PCT No.: PCT/KR2016/005232

§ 371 (c)(1),
(2) Date: Oct. 12, 2016

(87) PCT Pub. No.: WO2016/186437

PCT Pub. Date: Nov. 24, 2016

(65) Prior Publication Data

US 2017/0135551 A1 May 18, 2017

(30) Foreign Application Priority Data

May 20, 2015 (KR) ..... 10-2015-0070290
May 20, 2015 (KR) ..... 10-2015-0070291

(51) Int. Cl.
*A47L 15/42* (2006.01)

(52) U.S. Cl.
CPC ..... *A47L 15/4225* (2013.01); *A47L 15/4212* (2013.01); *A47L 15/4246* (2013.01); *A47L 15/4272* (2013.01); *A47L 15/4285* (2013.01)

(58) Field of Classification Search
CPC ..... A47L 15/4202; A47L 15/00–508; A47L 15/4212
See application file for complete search history.

(56) References Cited

U.S. PATENT DOCUMENTS

2006/0118145 A1 6/2006 Woo Woo
2012/0055518 A1* 3/2012 Kim ..... A47L 15/4206 134/105

FOREIGN PATENT DOCUMENTS

CN 101252869 A 8/2008
CN 201767940 U 3/2011
CN 203400110 U 1/2014
DE 3614345 C1 9/1987
DE 3614389 C1 9/1987
DE 102005058262 A1 6/2006
(Continued)

OTHER PUBLICATIONS

Machine Translation DE3614345C1 (Year: 1987).*

*Primary Examiner* — Spencer E Bell
(74) *Attorney, Agent, or Firm* — Dentons US LLP

(57) ABSTRACT

A dishwasher is disclosed. The dishwasher includes a cabinet, a tub defining a washing space therein, a sump disposed under and coupled to the tub, a pump for transferring washing water stored in the sump, and a base defining a lower part of the cabinet, wherein the sump includes a sump mount, the sump mount being temporarily mounted on the base, and the base includes a first position guide, the sump mount being mounted on the first position guide so as to guide the sump to a coupling position with respect to the base.

13 Claims, 5 Drawing Sheets

(56) References Cited

FOREIGN PATENT DOCUMENTS

| | | | |
|---|---|---|---|
| EP | 0243632 | A2 | 11/1987 |
| EP | 2233058 | A1 | 9/2010 |
| EP | 2233059 | A1 | 9/2010 |
| EP | 2583613 | A1 | 4/2013 |
| KR | 10-2007-0113639 | A | 11/2007 |
| KR | 10-2008-0057398 | A | 6/2008 |
| KR | 10-1296005 | B1 | 8/2013 |
| WO | 2007/027036 | A2 | 3/2007 |

* cited by examiner

[Fig. 1]
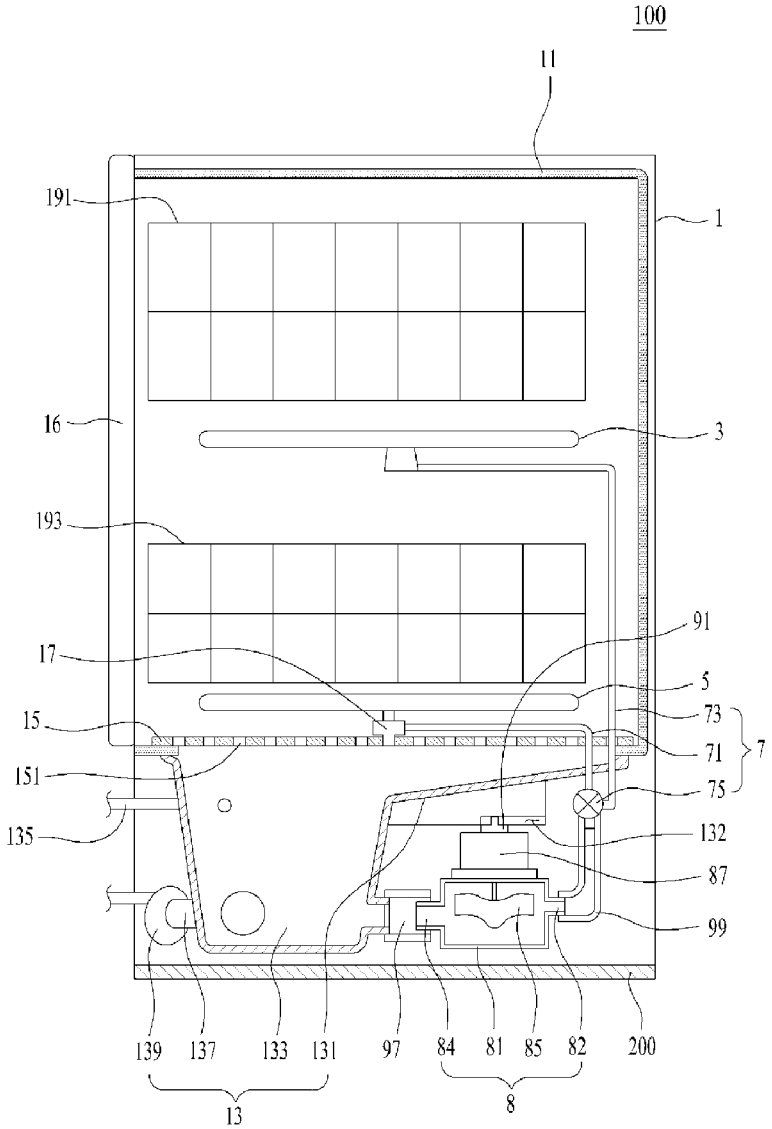

[Fig. 2]
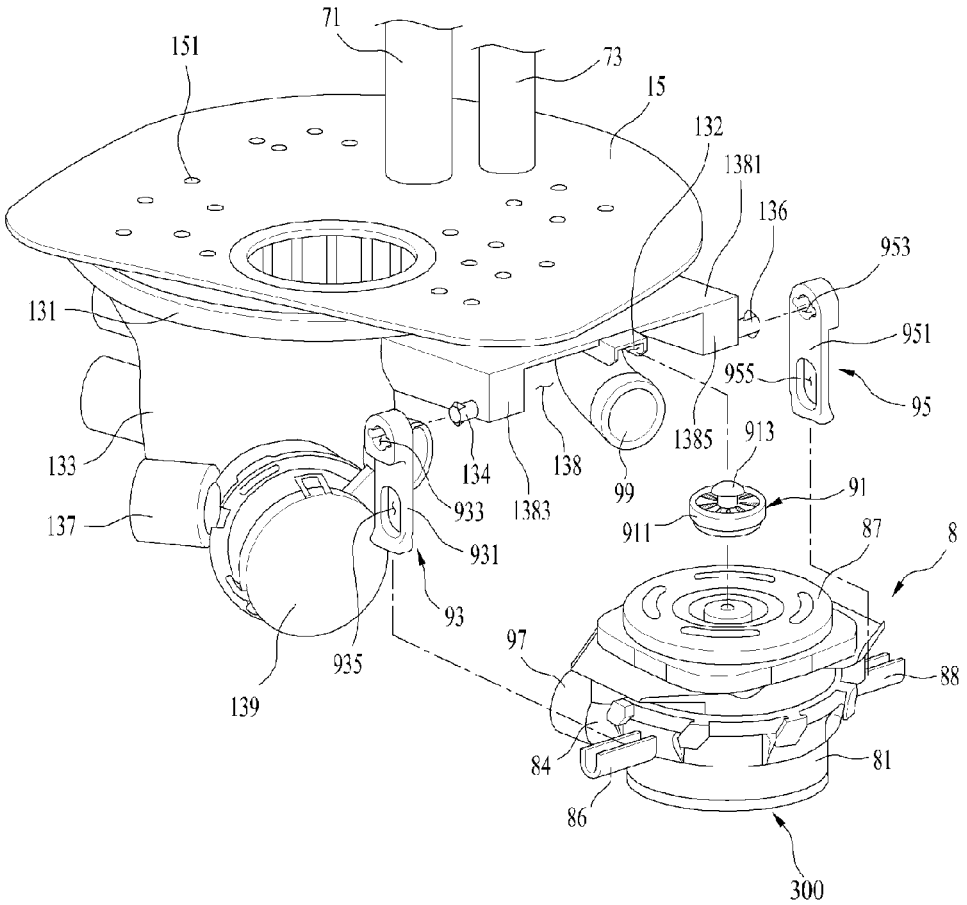

[Fig. 3]
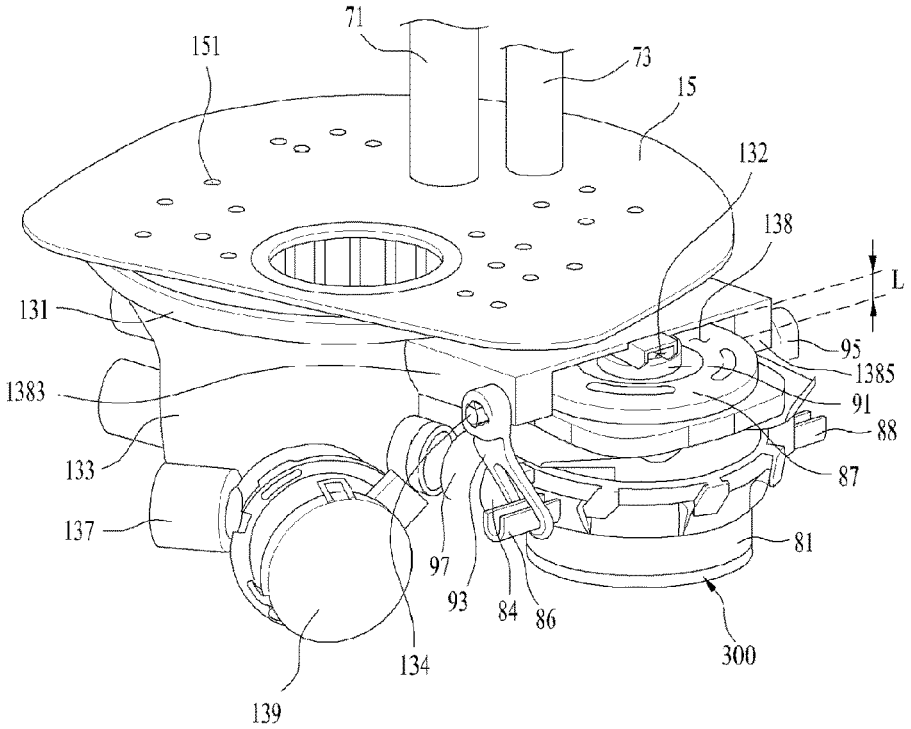
[Fig. 4]
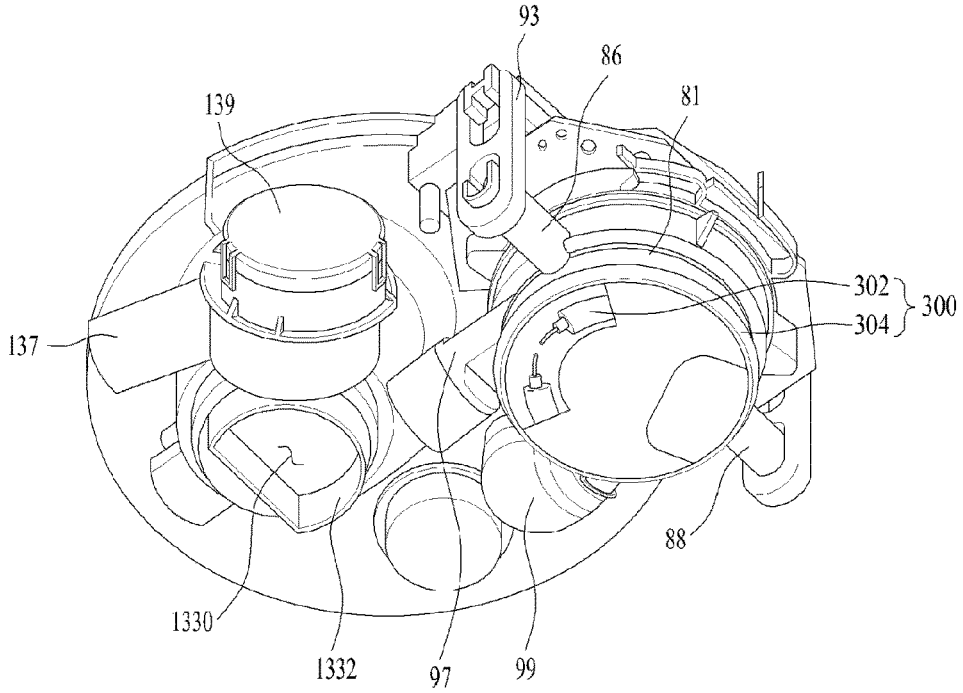

[Fig. 5]
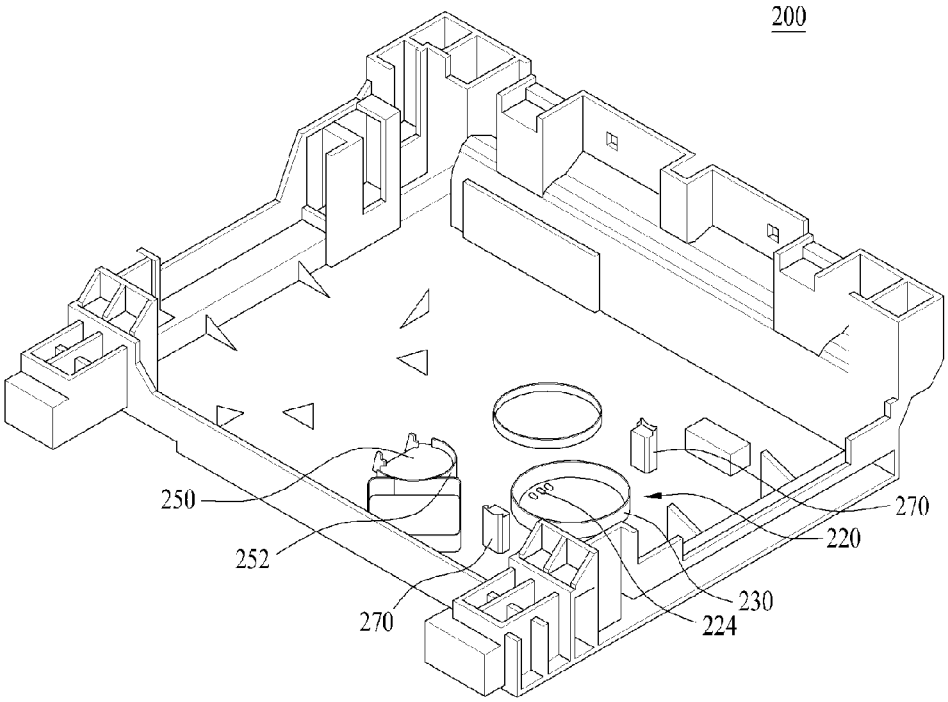
[Fig. 6]
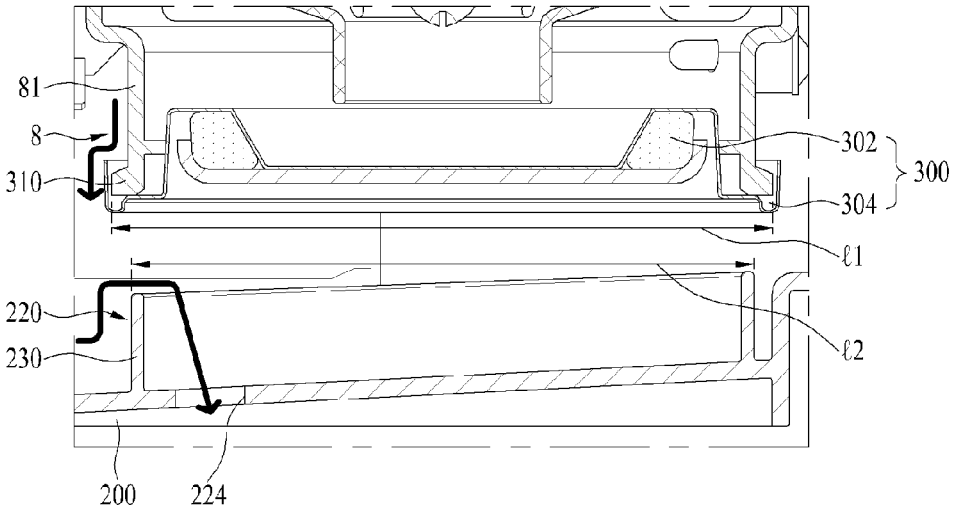

[Fig. 7]
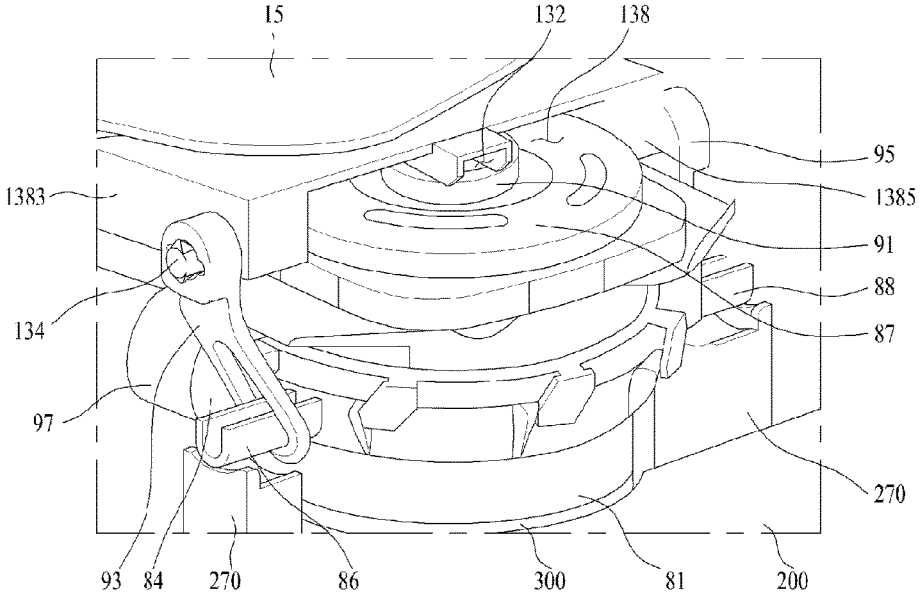
[Fig. 8]
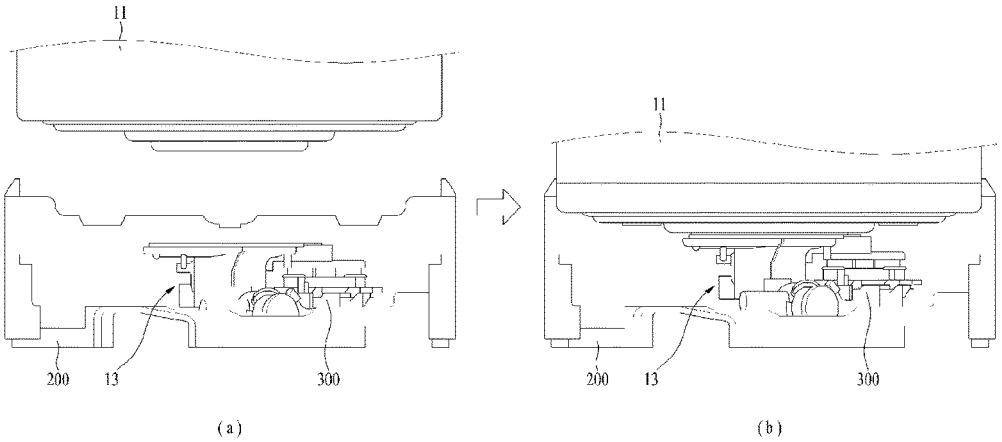

DISHWASHER AND METHOD OF MANUFACTURING THE SAME

This application is a National Stage Entry of International Application No. PCT/KR2016/005232, filed May 18, 2016, which claims the benefit of and priority to Korean International Application No. 10-2015-0070290, filed May 20, 2015 and Korean International Application No. 10-2015-0070291, filed May 20, 2015, all of which are hereby incorporated by reference in their entirety for all purposes as if fully set forth herein.

TECHNICAL FIELD

The present invention relates to a dishwasher and a method of manufacturing the same, and more particularly to a dishwasher capable of being easily assembled and a method of manufacturing the same.

Furthermore, the present invention relates to a dishwasher, and more particularly to a dishwasher capable of preventing the entry of water into electric components such as a heater.

BACKGROUND ART

A dishwasher is an apparatus to remove garbage, such as leftover food, from dishes or cooking utensils (hereinafter, "objects to be washed") using detergent and washing water.

In general, a dishwasher includes a tub providing a washing space, dish racks provided within the tub so as to receive objects to be washed, spray arms for spraying washing water to the racks, a sump for storing washing water therein, and a pump for supplying the washing water stored in the sump to the spray arms.

Various research has been conducted so as to develop a method of reducing assembly error upon the assembly of a dishwasher or to facilitate assembly of a dishwasher by a worker.

A dishwasher is typically provided with electric components such as a heater for heating washing water. However, when water splashes on or enters such electric components, there is a problem whereby a worker may be subjected to an electrical shock.

DISCLOSURE OF INVENTION

Technical Problem

Therefore, the present invention has been made in view of the above problems, and it is an object of the present invention to provide a dishwasher capable of being easily assembled and a method of manufacturing the same.

Another object of the present invention is to provide a dishwasher that is able to prevent water, leaking from inside the dishwasher, from entering electric components.

A further object of the present invention is to provide a dishwasher that is able to easily discharge water, leaking from inside the dishwasher, to the outside.

Solution to Problem

The object of the present invention can be achieved by providing a dishwasher including a cabinet, a tub defining a washing space therein, a sump disposed under and coupled to the tub, a pump for transferring washing water stored in the sump, and a base defining a lower part of the cabinet.

The sump may include a sump mount, the sump mount being temporarily mounted on the base, and the base may include a first position guide, the sump mount being mounted on the first position guide so as to guide the sump to a coupling position with respect to the base. When the dishwasher is assembled, since a worker mounts the sump on the base such that the sump mount is mounted on the first position guide, the worker can easily find the location at which the sump is to be mounted on the base, thereby reducing positional error in which the sump is incorrectly positioned.

The first position guide may include a semicircular curved part provided at a portion thereof so as to guide an orientation at which the sump mount is mounted on the first position guide. Specifically, since the first position guide is configured to be asymmetric in a specific direction, it is possible to easily find the correct position at which the sump is to be fitted into the base.

The sump mount may be mounted on the first position guide before the tub is coupled to the sump, and may be spaced apart from the first position guide when the tub is coupled to the sump. Since a space is defined between the sump mount and the first position guide when the dishwasher is completely assembled, it is possible to prevent noise or vibrations generated in the sump from being transmitted to the base and the cabinet through the sump mount and the first position guide.

The pump may include a coupler for coupling the pump to the sump, and the base may include a second position guide on which the coupled is mounted.

The coupler may include two couplers, and the second position guide may include two second position guides, whereby the sump and the pump are supported by the base. In particular, since the pump is coupled to the sump, the pump may be considered to be part of the sump. Here, the sump may be supported at three points. Accordingly, since the sump can be mounted on the base at three points, which are spaced apart from one another, it is possible to easily find the coupling position of the sump during assembly of the dishwasher.

The coupler may be coupled to an insulator provided at the sump, and the insulator may be made of rubber so as to absorb vibrations.

The coupler may be mounted on the second position mount before the tub is coupled to the sump, and may be spaced apart from the second position mount when the tub is coupled to the sump. Consequently, it is possible to prevent noise or vibrations of the sump from being transmitted to the base and the cabinet through the coupler and the second position guide.

The second position guide may be disposed under and spaced apart from the coupler so as to prevent the coupler from being excessively moved downward.

The sump may be supported at three points by the base.

In another aspect of the present invention, provided herein is a method of manufacturing a dishwater, including mounting a sump on a base constituting a lower part of a cabinet, mounting a tub on the sump, and coupling the sump to the tub, wherein the sump is moved upward toward the tub when the sump is coupled to the tub.

When the dishwasher is assembled, the sump may be placed on the base, and the tub may then be placed on the sump. When the sump is mounted on the base, the sump may be positioned at a specific location and orientation with respect to the base without coupling between the base and the sump.

After the tub is placed on the sump, the tub and the sump may be secured to each other.

When mounting the sump on the base, a sump mount may be mounted on a first position guide formed on the base, thereby enabling the location at which the sump is to be mounted on the base to be found.

Prior to mounting the sump on the base, a pump for transferring washing water may be coupled to the sump. Accordingly, after the sump is coupled to the pump, the sump may be placed on the base.

When mounting the tub on the sump, a coupler for coupling the pump to the sump may be mounted on a second position guide formed on the base, thereby enabling the sump to be mounted at an intended location on the base.

Since the first position guide and the second position guide are provided at different locations, it is possible for a worker to easily find the location of the sump when mounting the sump on the base for assembly of the dishwasher, thereby reducing assembly error.

In a further aspect of the present invention, provided herein is a dishwasher including a cabinet, a tub defining a washing space therein, a sump disposed under the tub so as to provide a space for storing washing water, a pump for supplying pressure to washing water stored in the sump, a heating unit disposed under the pump to heat washing water, and a base defining a lower part of the cabinet, wherein the base includes a water discharger disposed under the heating unit, and the water discharger has a water discharge hole through which water contained in the water discharger is discharged to the outside of the base.

The water discharger may include a partition wall, which is disposed along a circumference thereof and projects upward from the base.

A circumference of the partition wall may be smaller than an outer circumference of the heating unit.

The heating unit may include a guide protrusion formed along an outer circumferential surface thereof so as to guide water to the outside of the water discharger.

A circumference of the partition wall may be smaller than an outer circumference of the guide protrusion.

A circumference of the partition wall may be equal to or larger than an inner circumference of the guide protrusion.

The water discharger may be inclined at the bottom surface thereof such that the water discharge hole is positioned at a relatively low level, whereby water in the water discharger is guided to the lower position by gravity.

Advantageous Effects of Invention

According to the present invention, the dishwasher can be easily assembled by a worker. The assembly can be easily performed by a worker in such a way as to mount the sump on the base, place the tub on the sump and couple the sump to the tub.

Since the predetermined location and orientation at which the sump has to be mounted on the base can be easily found before the sump is coupled to the tub, the process of assembling the dishwasher is facilitated, and the incidence of errors during an assembly operation is reduced, thereby reducing the occurrence of defective products.

Furthermore, the present invention is able to prevent breakage of the pump body caused by contact with the base by restricting the vertical amplitude of vibration of the pump attributable to operation of the motor.

In addition, the present invention is able to prevent water from being transferred to electric components such as a heater even when water leaks from the inside of the dishwasher.

Furthermore, the present invention is able to prevent water from contacting electric components due to increased water level, which is in turn attributable to water leakage, by discharging the water to the outside of the dishwasher.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view illustrating a dishwasher according to an embodiment of the present invention;

FIG. 2 is an exploded view illustrating a sump, a pump and insulators;

FIG. 3 is a view illustrating the sump and the pump, which are coupled to each other;

FIG. 4 is a view illustrating the lower part of the assembly of FIG. 3;

FIG. 5 is a view illustrating a base;

FIG. 6 is a view illustrating an essential part of the embodiment;

FIG. 7 is a view illustrating the state in which a couplers are mounted on second position guides; and FIG. 8 is a view illustrating a procedure of coupling a tub to the sump.

BEST MODE FOR CARRYING OUT THE INVENTION

Hereinafter, preferred embodiments of the present invention, which are able to achieve the above objects, will be concretely described with reference to the accompanying drawings.

The shapes and sizes of components illustrated in the drawings may be exaggerated for clarity and convenience of description. The terms used in the following description, which are particularly defined in consideration of the construction and the functions of the present invention, may be replaced by other terms based on the user or operator's intentions or practices. The terms should be defined based on the overall contents of this specification.

As illustrated in FIG. 1, a dishwasher 100 according to an embodiment of the present invention includes a cabinet 1 defining the appearance of the dishwasher 100, a tub 11 disposed in the cabinet 1 so as to provide a washing space, racks 191 and 193 disposed in the tub 11 so as to receive objects to be washed, spray arms 3 and 5 for spraying washing water to the racks 191 and 193, a sump 13 for recovering the washing water sprayed into the tub 11, and a pump 8 for supplying the washing water contained in the sump 13 to the spray arms 3 and 5.

The cabinet 1 may be provided at the lower portion thereof with a base 200, which may define the appearance of the lower portion of the cabinet 1.

The racks may include a first rack (upper rack) 191, and a second rack (lower rack) 193 disposed below the first rack 191.

The cabinet 1 may be provided with a door 16 for opening and closing the tub 11, and the upper and lower racks 191 and 193 may be taken out of the cabinet 1 when the door 16 opens the tub 11.

The tub 11 may be provided on the inner surface thereof with rails (not shown) for guiding the movement of the racks 191 and 193 toward the door 16, and the racks 191 and 193 may be provided with rollers (not shown), which are supported by the rails.

The sump 13 may include a storage part 133 for storing washing water, a cover 15 disposed on the storage part 133 so as to isolate the tub 11 from the storage compartment 133, and a connecting part 131 connecting the storage part 133 to the cover 15.

In this embodiment, the cover 15 may further include recovery holes 151, which are formed through the cover 15 so as to supply washing water to the storage part 133.

The recovery holes 151 may be formed only in the region of the cover 15 that is positioned directly over the storage part 133, or may be formed in the entire region of the cover 15 so as to allow the washing water contained in the tub 11 to be supplied to the connecting part 131.

The connecting part 131 may be inclined toward the storage part 133 at a predetermined angle so as to guide washing water, introduced through the recovery holes 151, to the storage part 133.

The tub 11 is preferably positioned over the cover 15. The reason for this is to allow washing water, which is sprayed to the tub 11 from the spray arms 3 and 5, to be recovered into the storage part 133 through the recovery holes 151 and the connecting part 131 without using an additional device.

The cover 15 may be configured to have any form as long as it partitions the internal space of the cabinet 1, and the connecting part 131 may be secured to the lower surface of the cover 15.

The connecting part 131 may be configured to surround the entire space under the cover 15 (the cover 15 and the body having the same plane area) or to surround only the space corresponding to the region in which the recovery holes 151 are formed.

The storage part 133 may be shaped by bending the cover 15 to be concave toward the bottom wall of the cabinet 1. It is preferable that the storage part 133 have a smaller sectional area than the connecting part 131 and that the connecting part 131 be inclined toward the storage part 133.

When the storage part 133 is configured to have a smaller sectional area than the connecting part 131, the pump 8 may be positioned under the connecting part 131, thereby enabling minimization of the volume of the dishwasher 100.

The storage part 133 receives washing water through a water supply channel 135 connected to the water supply source (not shown), and the washing water stored in the storage part 133 is discharged to the outside through a water discharge channel 137 and a water discharge pump 139.

The spray arms may include a lower spray arm 5, which is disposed in the tub 11 so as to wash the objects received in the lower rack 193, and an upper spray arm 3 for washing the objects received in the upper rack 191.

Each of the lower spray arm 5 and the upper spray arm 3 receives washing water through the pump 8 and a supply channel 7. The supply channel 7 may include a first supply channel 71 connected to the lower spray arm 5, a second supply channel 73 connected to the upper spray arm 3, and a transfer valve 75 for selectively opening the supply channels 71 and 73.

When the lower spray arm 5 is rotatably disposed in the tub 11, the lower spray arm 5 is rotatably coupled to a holder 17 provided at the cover 15, and the first supply channel 71 may be configured to supply washing water to the holder 17.

When the upper spray arm 3 is rotatably disposed in the tub 11, the upper spray arm 3 may be rotatably coupled to the second supply channel 73.

The pump 8 may include a housing 81 accommodating an impeller 85 therein, an introduction port 84 through which washing water is introduced into the housing 81, a discharge port 82 through which the washing water in the housing 181 is discharged, and a motor 87, which is disposed outside the housing 181 so as to rotate the impeller 186.

The introduction port 84 is connected to the storage part 133 via an introduction port connecting pipe 97, and the discharge port 82 is connected to the transfer valve 75 via a discharge port connecting pipe 99.

Consequently, when the impeller 85 is rotated in response to the supply of power to the motor 87, washing water, which is introduced into the housing 81 from the sump 13, is transferred to the transfer valve 75 through the discharge port 82, and the washing water, which is supplied to the transfer valve 75, is supplied to the upper spray arm 3 or the lower spray arm 5 through the supply channel 73 or 71, which is opened by the transfer valve 75.

The pump 8 is secured in the cabinet 1 via insulators 91, 93 and 95, which serve to attenuate vibrations generated in the pump 8 to thus prevent the vibrations generated in the pump 8 from being transmitted to the sump 13 and the cabinet 1.

The insulators, which are provided in the dishwasher according to the present invention, preferably include at least two insulators in order to cause the outer circumferential surface of the pump 8 to be spaced apart from the bottom surface of the cabinet 1 and from the sump 13 by respective predetermined distances.

As illustrated in FIG. 2, the insulators may include only a first insulator 93 and a second insulator 95, which serve to cause the bottom surface of the pump 8 to be spaced apart from the bottom surface of the cabinet 1 by a predetermined distance, or may further include a third insulator 91, which causes the upper surface of the pump 8 to be spaced apart from the sump 13 by a predetermined distance, in addition to the first and second insulators.

Since the pump 8 is provided on the upper surface thereof with the motor 87 for rotating the impeller 85 disposed in the housing 81, the third insulator 91 serves to maintain the distance between the motor 87 and the sump 13.

Furthermore, the first insulator 93 and the second insulator 95 serve to maintain a spacing between the bottom surface of the housing 81, which defines the lower surface of the pump 8, and the bottom surface of the cabinet 1.

The third insulator 91 may include a third body 911, which contacts the upper surface of the motor 87, and a projection 913, which projects from the third body 911 so as to contact one of the connecting part 131 of the sump 13 or the cover 15.

FIG. 2 illustrates the case in which the third insulator 91 contacts the connecting part 131. In this case, the connecting part 131 is preferably provided with an accommodator 138, which provides a space capable of accommodating the upper portion of the pump 8.

The accommodator 138 may include an accommodating body 1381, which projects from the connecting part 131 so as to be parallel to the bottom surface of the cabinet 1, and first and second flanges 1383 and 1385, which project from the accommodating body 1381 toward the bottom surface of the cabinet 1 so as to be spaced apart from each other by a predetermined distance.

The accommodator 138 is further provided with a third support 132, by which the projection 913 is supported so as to support the third insulator 91. The third support 132 is formed by depressing the inner surface of the accommodating body 1381 toward the cover 15 so as to provide the surface with a recess or by providing the inner surface of the accommodating body 1381 with a circumferential rib, which projects toward the bottom surface of the cabinet 1 from the inner surface so as to provide the rib with a recess, whereby the projection 913 is received in the recess.

In any case, it is preferable that the third support 132 be disposed in the marginal area of the accommodator 138 and that it be directed toward the storage part 133 so as to guide the movement of the projection 913 when the pump 8 is assembled (so as to guide the movement of the pump 8 when the pump 8 is moved by the tensile force of the first and second insulators).

The third insulator 91 may be made of any material, as long as it is able to attenuate the vibration of the motor 87. In an example, the third insulator 91 may be made of a resilient material such as rubber.

In order to minimize the transmission of vibrations from the motor 87 to the sump 13, the projection 913 preferably has a smaller sectional area than the third body 911.

If the third body 911 has a hole, which is formed through the third body 911, or a recess formed in the surface of the third body 911 (which is disposed along the circumferential surface of the projection 913), the effect of attenuating vibrations by the third body 911 will be further increased.

The first insulator 93 may be constituted by a first body 931, which is connected at one end thereof to the connecting part 131 and at the other end thereof to the housing 81. The first body 931 may also be made of any material as long as it is able to attenuate the vibrations generated in the pump 8. In an example, the first body 931 may be made of a resilient material such as rubber.

The connecting part 131 and the housing 81 should be respectively provided with a first support 134, coupled to the first body 931, and a first coupler 86. FIG. 2 illustrates the case in which the first body 931 is removably coupled to the accommodator 138 positioned at the connecting part 131. In this case, the first support 134 should be provided at the first flange 1383, which constitutes the accommodator 138.

The structure by which the first body 931 is coupled to the first support 134 or the first coupler 86 may be configured in various manners. FIGS. 2 and 3 illustrate the case in which the first support 134 projects from the outer surface of the accommodator 138, and the first coupler 86 projects from the housing 81.

In this case, the first body 931 may be provided with a first support coupling hole 933 into which the first support 134 is fitted, and a first body slit 935 into which the first coupler 86 is fitted.

Here, it is preferable that the first body slit 935 be formed through the first body 931 and that the width of the first body 931 in a longitudinal direction (in the height direction of the cabinet 1) be greater than the width of the first body 931 in a lateral direction (in the width direction of the cabinet 1). The reason for this is to facilitate the assembly of the first body 931 with the first coupler 96.

The second insulator 95 may be configured to have the same structure as that of the first insulator 93. Specifically, the second insulator 95 may include a second body 951, which is also made of a material capable of attenuating vibrations, and a second support coupling hole 953 and a second body slit 955, which are formed in the second body 951.

In this case, the accommodator 138 should be provided on the outer surface thereof (on the second flange 1385) with a second support 136, which is fitted into the second support coupling hole 953, and the pump 8 should be provided with a second coupler 88, which projects from the housing 81 and is fitted into the second body slit 955.

It is preferable that the second body slit 955 be formed through the second body 951 and that the width of the second body 951 in a longitudinal direction (in the height direction of the cabinet 1) be greater than the width of the second body 951 in a lateral direction (in the width direction of the cabinet 1).

Although the first insulator 93, the second insulator 95 and the third insulator 91 have been described as being used in the case in which the pump 8 is secured to the accommodator 138, these insulators may also be used in the case in which the pump 8 is secured to the cover 15.

In the dishwasher 100, which is configured to have the above-described structure, vibrations generated in the pump 8 may be transmitted to the sump 13 or the cabinet 1 through the introduction port connecting pipe 97, which connects the pump 8 to the storage part 133 and through the discharge port connecting pipe 99, which connects the pump 8 to the transfer valve 75.

Accordingly, the introduction port connecting pipe 97 and the discharge port connecting pipe 99 are preferably made of a material capable of absorbing vibrations (for example, a resilient material). In this case, the introduction port connecting pipe 97 and the discharge port connecting pipe 99 will respectively serve as a fourth insulator and a fifth insulator.

The dishwasher 100 is constructed such that the pump 8 is secured to the sump 13 in the following manner.

As illustrated in FIG. 2, a worker fits the first support coupling hole 933 over the first support 134 to secure the first insulator 93 to the accommodator 138, and fits the second support coupling hole 953 over the second support 136 to secure the second insulator 95 to the accommodator 138.

Since the first insulator 93 and the second insulator 95 are made of a material such as rubber, which is able to attenuate vibrations, the worker stretches the first body 931 and the second body 951 so as to respectively couple the first body slit 935 and the second body slit 955 to the first coupler 86 and the second coupler 88 of the housing 81.

Subsequently, the worker couples the third insulator 91 mounted on the upper surface of the motor 87 to the third support 132. Here, the third support 132 will guide the movement of the projection 913 of the third insulator 91. Accordingly, if the worker merely positions the projection 913 at the third support 132, the pump 8 will be moved to a predetermined location and secured to the sump 13 by virtue of the elasticity of the first and second insulators (the tensile force with which the pump 8 is pulled toward the sump 13 by the first and second insulators) and the guidance of the third support 132, as illustrated in FIG. 3.

As illustrated in FIG. 3, it is sufficient to set the tensile force applied to the pump 8 by the first and second insulators 93 and 95 to a value such that the upper surface of the pump 8 is spaced apart from the surface of the accommodator 138 by a distance L.

The dishwasher 100 according to the embodiment of the present invention, which is constructed in the above-described manner, prevents vibrations generated in the pump 8 from being transmitted to the sump 13 or the cabinet 1, thereby reducing the noise and vibration of the dishwasher 100. Furthermore, since the pump 8 is disposed in the space under the connecting part 131, in which the storage part 133 is not provided, there is an effect of minimizing the volume of the dishwasher 100.

Meanwhile, the pump 8 may be provided thereunder with a heating unit 300, which includes a heater or the like, so as to heat washing water transferred by the pump 8.

As illustrated in FIG. 4, the heating unit 300 includes a heater 302 for heating washing water and a heater mount 304 on which the heater 302 is mounted.

The heater 302 may generate heat and thus heat washing water by the application of power.

The heating unit 300 may include a temperature control module, which is connected to the heater 302 so as to apply power to the heater depending on the temperature of the heater 302. The temperature control module may include a thermal fuse, which is connected to the heater 302 so as to receive heat from the heater 302 and to interrupt the supply of power depending on the temperature of heat transferred thereto, and a wire connecting the thermal fuse to the heater 302.

As described above, since the heating unit 300 includes various electric components, the heating unit may be subject to problems of electric shock, breakage or the like when the heating unit 300 contacts water.

Referring to FIGS. 5 and 6, the base 200 includes a water discharger 220, which is disposed under the heating unit 300. The water discharger 220 is disposed under the heating unit 300 while the dishwasher is operated after assembly thereof.

As illustrated in FIG. 4, the heating unit 300 is configured to have a circular shape overall. The water discharger 220 may also be configured to have circular shape, which is similar to the overall contour of the heating unit 300.

The water discharger 220 has therein a water discharge hole 224 through which the water contained in the water discharger 220 is discharged to the outside of the base.

The water discharge hole 224 may comprise a plurality of water discharge holes such that the water contained in the water discharger 220 is discharged to the outside of the base 200 through the water discharge holes.

Washing water leaking from the inside of the cabinet 1 is collected in the base 200. Since the water collected in the water discharger 220 is discharged through the water discharge holes 224, it is possible to solve a problem whereby water contacts the heating unit 300 due to the high water level in the water discharger 220.

The water in the sump 13 may leak due to breakage of a seal of the sump 13 or the high water level in the sump 13. In addition, water may leak from a pipe through which water flows, regions at which various components are coupled, or the like.

Furthermore, since the water discharger 220 is inclined at the bottom surface thereof such that the water discharge holes 224 are positioned at a relatively low level, the water collected in the water discharger 220 may be guided to the water discharge holes 224 and discharged to the outside of the base 200.

The water discharger 220 may include a partition wall 230, which projects upward from the base 200. The partition wall 230 may be disposed along the outline of the water discharger 220 so as to isolate the water discharger 220.

The partition wall 230 may prevent the water contained in the base 200 from splashing upward and reaching the heating unit 300 due to vibration of the pump 8 or the like. In addition, the partition wall 230 may prevent water outside the partition wall 230 from being transferred to the area under the heating unit 300, that is, the water discharger 220.

The partition wall 230 may project upward to such an extent that it does not contact the heating unit 300.

The circumference of the partition wall 230 may be less than the outer circumference of the heating unit 300. Consequently, since the circumference of the partition wall 230 is less than the outer circumference of the heating unit 300, water such as washing water flowing down from the upper portion of the heating unit 300, cannot be introduced into the water discharger 220, thereby preventing an increase in the water level in the water discharger 220.

The heating unit 300 may include a guide protrusion 310, which is formed along the outer circumferential surface of the heating unit 300. The guide protrusion 310 may extend along the outer circumferential surface of the heater mount 304 so as to increase the surface area of the heating unit 300.

Accordingly, since water leaking from the upper portion of the heating unit 300 flows along the guide protrusion 310, the water may be guided away from the center of the heating unit 300.

Since the guide protrusion 310 is configured to have a sectional area that increases moving downward, water flowing down from above may be transferred in a direction that is laterally inclined, rather than in a vertical direction.

The circumference of the partition wall 230 may be less than the outer circumference of the guide protrusion 310. In other words, since the diameter 11 of the circle defined by the guide protrusion 310 is greater than the diameter 12 of the circle defined by the partition wall 230, water flowing down along the guide protrusion 310, may be guided to the outside of the water discharger 220 without falling into the water discharger 220.

The diameter 12 of the circle defined by the partition wall 230 may be the same as or greater than the diameter of the circle defined by the inner circumferential surface of the guide protrusion 310. Although FIG. 6 illustrates the case in which the two diameters are the same, the diameter 12 of the circle defined by the partition wall 230 may be larger, unlike the case illustrated in FIG. 6.

Since the partition wall 230 prevents water from being transferred to the heating unit 300, the partition wall 230 may have sufficient area to completely surround the heating unit 300. Accordingly, the partition wall 230 may be configured to have an area such that water flowing down along the guide protrusion 310 does not enter the partition wall 230, while surrounding the entire area of the heating unit 300.

Therefore, a problem, whereby the water in the water discharger 220 contacts the heating unit 300 due to the increased water level in the water discharger 220, is prevented.

As illustrated in FIG. 4, the sump 13 is provided thereunder with a sump mount 1330. The sump mount 1330 may be configured to have a 'D' shape overall such that it is not symmetrical when viewed from a particular direction. The asymmetry of the sump mount 1330 is such that one side part thereof is configured to have a linear cross section whereas the other side part thereof is constituted by a curved part 1332 having a curved cross section.

The sump mount 1330 may be positioned at the bottom of the sump 13, and may extend a predetermined distance in the downward direction of the sump 13.

The base 200 may be provided with a first position guide 250 on which the sump mount 1330 is temporarily mounted. The first position guide 250 may guide the sump 13 to an initial coupling position when the sump mount 1330 is assembled with the dishwasher.

The first position guide 250 may include a semicircular curved part 252 in a region thereof so as to restrict the direction in which the sump mount 1330 is mounted on the first position guide 250. The first position guide 250 may be provided at a region thereof opposite the curved part 252 with a linear part on which the linear part of the sump mount 1330 is mounted such that the first position guide 250 is engaged with the sump mount 1330.

In other words, the first position guide 250 may be configured to have a shape similar to that of the sump mount 1330 such that the sump mount 1330 is fitted into the first position guide 250.

Since the first position guide 250 and the sump mount 1330 are configured to be asymmetric in a specific direction, a worker may maintain the direction, in which the sump mount 1330 is coupled to the first position guide 250, constant. Accordingly, a worker can easily find the location at which the sump 13 is mounted on the base 200 in order to perform an assembly operation.

The base 200 includes second position guides 270 on which the couplers 86 and 88 for coupling the pump 8 to the sump 13 are mounted.

The second position guides 270 may project upward from the base 200 such that the couplers 86 and 88 are temporarily mounted on the second position guides 270. When the couplers 86 and 88 are mounted on the second position guides 270, the pump 8 is spaced apart from the bottom surface of the base 200 without contacting the bottom surface.

Since the pump 8 is relatively heavy compared to other components of the dishwasher, some of the load of the pump 8 may be supported by the second position guides 270, which are located near the pump 8, during the assembly of the dishwasher.

The couplers 86 and 88 may include two couplers, that is, the first coupler 86 and the second coupler 88, and the second position guides 270 may correspondingly include two guides, that is, a first guide for supporting the first coupler 86 and a second guide for supporting the second coupler 88.

Referring to FIG. 7, when the couplers 86 and 88 are configured to have a round cross section, each of the second position guides 270 may be provided at a corresponding region thereof with a recess in which the coupler 86 or 88 is seated. Consequently, each of the couplers 86 and 88 may be seated on a predetermined area on the second position guide 270.

Since the second position guides 270 support the couplers 86 and 88 while being in contact with lower portions of the couplers 86 and 88, the second position guides 270 may be positioned at a high level from the bottom of the base 200 compared to the first position guide 250. In other words, since the sump mount 1330 can extend downward from the sump 13 as far as possible, it is not necessary for the first position guide 250 to project upward higher than the second position guides 270.

FIG. 8 is a view illustrating an operation of fitting the tub with the sump.

Referring to FIGS. 4 to 8, the sump 13 is first mounted on the base 200.

At this time, the sump mount 1330 may be coupled to the first position guide 250, and the couplers 86 and 88 may be coupled to the second position guides 270. The sump mount 1330 may be mounted on the first position guide 250, and the couplers 86 and 88 may be mounted on the second position guides 270.

Since the sump 13 is supported at three points by the base 200 and is an object having considerable weight, the sump 13 may be stably maintained at the initial coupling position with respect to the base 200 even though the sump 13 is not fastened to the base 200 by means of fastening elements such as bolts.

Furthermore, since the sump 13 is in contact with the base 200 at three points, it is possible to prevent the orientation of the sump 13 from being misaligned with the orientation of the base 200. The reason for this is because the orientation of the sump 13 may be misaligned if the sump 13 is coupled only at one point to the base 200.

Specifically, since the sump mount 1330 is configured to be asymmetric and the first position guide 250 is also configured to be asymmetric, there is an advantage in that a worker can easily find a predetermined coupling direction when the sump mount 1330 is coupled to the first position guide 250.

Here, the sump 13 is already coupled to the pump 8.

Specifically, as illustrated in FIG. 8(*a*), the sump 13 is mounted on the base 20 before the tub 11 is coupled to the sump 13. At this time, in order to make it easy to determine the initial coupling position of the sump 13, the first position guide 250 and the second position guides 270 are used.

As illustrated in FIG. 8(*b*), the tub 11 may be coupled to the sump 13. Here, the tub 11 may be coupled to the sump 13 by means of fastening elements such as bolts.

When the tub 11 is coupled to the sump 13, the sump 13 is raised from the base 200 and is thus spaced apart from the base 200.

Specifically, the sump mount 1330 may be raised so as to be spaced apart from the first position guide 250, and the couplers 86 and 88 may be raised so as to be spaced apart from the second position guides 270.

This is because the sump 13 is raised by the tub 11 so as not to contact the base 200 when the tub 11 is coupled to the sump 13.

In other words, the first position guide 250 and the second position guides 270 may serve to guide the sump 13 to the initial coupling position with respect to the base 200 before the sump 13 is coupled to the tub 11.

Since the initial position of the sump 13 can be easily determined by virtue of the first position guide 250 and the second position guides 270, it is possible to prevent erroneous assembling work or the like, in which the sump 13 is placed at an incorrect location or in an incorrect orientation when a worker couples the tub 11 to the sump 13.

Since the region of the sump 13 at which the pump 8 is positioned is heavy and the insulators 93 and 95 are made of rubber, vibration may be generated in the pump 8 during the operation of the motor. At this time, although the insulators 93 and 95 can absorb some of the vibration, it is impossible to prevent vertical movement of the pump 8 caused by excessive vibration.

Since the second position guides 270 are positioned under the couplers 86 and 88 while being spaced apart from the couplers 86 and 88, the couplers 86 and 88 do not come into contact with the second position guides 270 as long as the pump 8 does not vibrate.

However, when excessive vibration is generated in the pump 8, the insulators 93 and 95 may be stretched. When the couplers 86 and 88 are moved downward as a result of the stretching of the insulators 93 and 95, the second position guides 270 are able to prevent the couplers 86 and 88 from being moved downward any further. In other words, the couplers 86 and 88 are able to prevent excessive downward movement of the pump 8, and to thus prevent the pump 8 from striking the bottom surface of the base 20.

MODE FOR THE INVENTION

Various embodiments have been described in the best mode for carrying out the invention.

INDUSTRIAL APPLICABILITY

The present invention provides a dishwasher capable of being easily assembled by a worker.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A dishwasher comprising:

a cabinet;

a tub defining a washing space therein;

a sump disposed under and coupled to the tub;

a pump for transferring washing water stored in the sump;

a heating unit disposed under the pump so as to heat washing water; and a base defining a lower part of the cabinet, wherein the sump includes a sump mount, the sump mount being temporarily mounted on the base after the pump and the heater are coupled to the sump, and the base includes a first position guide, the sump mount being mounted on the first position guide so as to guide the sump to a coupling position with respect to the base, wherein the sump mount is coupled into the first position guide, wherein the first position guide and the sump mount are configured to be asymmetric in a specific direction, wherein the sump mount has a 'D' shape section having a linear cross section and a curved cross section such that the sump mount is coupled to the first position guide in a consistent direction, wherein the pump includes a coupler for coupling the pump to the sump, and the base includes a second position guide on which the coupler is mounted, wherein the coupler includes two couplers, and the second position guide includes two second position guides separated from each other, and wherein the sump is supported at three points by the first position guide and the second position guides of the base after the pump and the heater are coupled to the sump.

2. The dishwasher according to claim 1, wherein the first position guide includes a semicircular curved part provided at a portion thereof so as to guide an orientation at which the sump mount is mounted on the first position guide.

3. The dishwasher according to claim 1, wherein the sump mount is mounted on the first position guide before the tub is coupled to the sump, and is spaced apart from the first position guide when the tub is coupled to the sump.

4. The dishwasher according to claim 1, wherein the coupler is coupled to an insulator provided at the sump, and the insulator is made of rubber so as to absorb vibrations.

5. The dishwasher according to claim 1, wherein the coupler is mounted on the second position guide before the tub is coupled to the sump, and is spaced apart from the second position guide when the tub is coupled to the sump.

6. The dishwasher according to claim 5, wherein the second position guide is disposed under and spaced apart from the coupler so as to restrict a range within which the coupler is vertically moved.

7. The dishwasher according to claim 1, further comprising:

a water discharger provided at the base while being disposed under the heating unit, wherein the water discharger has a water discharge hole through which water contained in the water discharger is discharged to an outside of the base.

8. The dishwasher according to claim 7, wherein the water discharger includes a partition wall, which is disposed along a circumference thereof and projects upward from the base.

9. The dishwasher according to claim 8, wherein a circumference of the partition wall is less than an outer circumference of the heating unit.

10. The dishwasher according to claim 8, wherein the heating unit includes a guide protrusion formed along an outer circumferential surface thereof.

11. The dishwasher according to claim 10, wherein a circumference of the partition wall is less than an outer circumference of the guide protrusion.

12. The dishwasher according to claim 10, wherein a circumference of the partition wall is equal to or greater than an inner circumference of the guide protrusion.

13. The dishwasher according to claim 7, wherein the water discharger is inclined at the bottom surface thereof such that the water discharge hole is positioned at a relatively low level.

* * * * *